US011644763B2

(12) United States Patent
Kurauchi et al.

(10) Patent No.: US 11,644,763 B2
(45) Date of Patent: May 9, 2023

(54) IMAGE FORMING APPARATUS INCLUDING PHOTORECEPTOR CONNECTED TO GROUND VIA AN INDUCTOR

(71) Applicant: SHARP KABUSHIKI KAISHA, Sakai (JP)

(72) Inventors: Takahiro Kurauchi, Sakai (JP); Shintaro Miyanishi, Sakai (JP); Norihide Momose, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/365,639

(22) Filed: Jul. 1, 2021

(65) Prior Publication Data

US 2022/0019152 A1 Jan. 20, 2022

(30) Foreign Application Priority Data

Jul. 17, 2020 (JP) ..... JP2020-122914

(51) Int. Cl.
*G03G 15/02* (2006.01)
*G03G 21/00* (2006.01)
*G03G 5/047* (2006.01)

(52) U.S. Cl.
CPC ..... *G03G 15/0266* (2013.01); *G03G 5/047* (2013.01); *G03G 21/0005* (2013.01)

(58) Field of Classification Search
CPC ..... G03G 5/047; G03G 15/751
See application file for complete search history.

(56) References Cited

U.S. PATENT DOCUMENTS 4,851,960 A 7/1989 Nakamura et al.
5,313,359 A * 5/1994 Imagawa ..... G03G 15/0266 361/221
5,768,653 A * 6/1998 Fare ..... G03G 15/0216 399/176
2018/0307147 A1* 10/2018 Suzuki ..... G03G 5/0651

FOREIGN PATENT DOCUMENTS

JP S63-149668 A 6/1988
JP H0744059 A * 2/1995
JP 2003-316112 A 11/2003

OTHER PUBLICATIONS

Translation of JP 2003-316112.*

(Continued)

*Primary Examiner* — Arlene Heredia
(74) *Attorney, Agent, or Firm* — ScienBiziP, P.C.

(57) ABSTRACT

The image forming apparatus includes a photoreceptor, a charger that charges a surface of the photoreceptor, an exposer that irradiates the charged surface of the photoreceptor with light to form an electrostatic latent image, a developer that develops the electrostatic latent image to form a toner image, a transferer that transfers the toner image onto a recording medium, a cleaner that removes residual toner on the surface of the photoreceptor, and an inductor. The photoreceptor includes a conductive substrate and a photoreceptive layer provided on the conductive substrate. The conductive substrate is connected to a ground via the inductor.

6 Claims, 4 Drawing Sheets

(56) References Cited

OTHER PUBLICATIONS

Yasunor Ohkuma et al., "Roller-Electrification and Non-Uniformity in the Electrification—A Basic Study for Electrophotography-", Journal of the Imaging Society of Japan vol. 42 No.3 p. 209-p. 214, (2003).
Masao Ohmori et al., "Measurement Techniques of Micro Region Discharge Current for Analysis Discharge Mode of Contact Charging Roller", Journal of the Imaging Society of Japan vol. 56 No.1 p. 98-p. 106 (2017).

* cited by examiner

IMAGE FORMING APPARATUS INCLUDING PHOTORECEPTOR CONNECTED TO GROUND VIA AN INDUCTOR

BACKGROUND OF THE INVENTION

Field of the Invention

The present invention relates to an image forming apparatus.

DESCRIPTION OF THE BACKGROUND ART

Electrophotographic image forming apparatuses for forming an image with the use of an electrophotographic technology are widely used in copiers, printers, facsimiles, and the like.

As the charger of the electrophotographic image forming apparatus, a corotron charger using a wire and a case, a scorotron charger using a wire, a case, and a grid electrode (hereinafter, also referred to as a "grid") are often used. In particular, the scorotron charger has an advantage that the surface potential of the photoreceptor can be stably controlled by the grid arranged between the wire and the surface of the photoreceptor, and is widely used as a charger.

However, these chargers have a drawback that a high voltage of 5 to 8 kV needs to be applied and a large amount of ozone is generated. Accordingly, in order to eliminate such a drawback, as a charger that brings the charger into contact with or close to the photoreceptor, for example, a charger such as a contact roller charger, a non-contact roller charger, a brush charger, or a magnetic brush charger has been developed.

Except for some injection charging methods, these chargers use a charging method using microcavity discharge and can reduce power consumption compared to conventional scorotron chargers, and have become the current mainstream chargers as chargers that can solve the issue of high-voltage power supply and ozone generation, which have been their drawbacks.

However, these chargers have advantages such as power saving cost as compared to conventional scorotron chargers, but at the same time, uniform charging on the surface of the photoreceptor is an issue. Specifically, in an image forming apparatus using a photoreceptor and a contact type charging device, scaly image unevenness due to uneven charging may occur on an output image. Image unevenness caused by uneven charging due to such abnormal discharge is particularly likely to occur when the photoreceptor is charged by DC charging in which only a direct current voltage is applied to the charging roller.

Accordingly, in order to suppress the occurrence of this image unevenness, a contact charging method using alternating current charging method has been proposed in which a voltage (pulsating voltage) obtained by superimposing an alternating current voltage component having an inter-peak voltage at least twice the charging start voltage on a direct current voltage corresponding to the desired surface potential of the photoreceptor is applied to a contact charging member (for example, Japanese Unexamined Patent Application Publication No. 63-149668).

However, in such a type of charger that superimposes an alternating current voltage, a large amount of alternating current is consumed, the film of the photoreceptor is often reduced, and a photoreceptor leak is likely to occur. In addition, since the high-voltage alternating current voltage is superimposed, an AC power supply is required separately from the DC power supply, which causes many issues such as an increase in the cost of the device per se.

Moreover, a method has been proposed in which resin particles are contained in the surface layer of the charging roller to form irregularities on the surface of the charging roller to suppress abnormal discharge (for example, Japanese Unexamined Patent Application Publication No. 2003-316112). It is considered that this is because the presence of irregularities on the surface of the charging roller forms minute voids in the nip portion with the photoreceptor to be charged, causing point-like discharge and suppressing uneven charging. However, it is known that if the irregularities of the surface of the charging roller is increased, the image fog becomes worse.

On the other hand, the photoreceptor used in an electrophotographic process is formed by laminating a photoreceptive layer containing a photoconductive material on a conductive substrate made of a conductive material. Photoconductive materials include inorganic photoconductive materials and organic photoconductive materials (Organic Photoconductor: OPC). Photoreceptors (also referred to as "organic photoreceptors") including a photoreceptive layer containing an organic photoconductive material as a main component occupy the mainstream of photoreceptors. Recent research and development have improved sensitivity and durability of the photoreceptors.

As the organic photoreceptors, a configuration in which a monolayer-type photoreceptive layer in which a charge generating substance and a charge transporting substance are dispersed in a binder resin is included on a conductive substrate, and a configuration in which a negatively charged laminated-type photoreceptive layer in which a charge transporting layer in which a charge transporting substance is dispersed in a binder resin is laminated is included on a charge generating layer in which a charge generating substance is vapor-deposited or dispersed in a binder resin have been proposed. Among the configurations, the latter function separable-type photoreceptor has excellent electrophotographic property and durability and high freedom in selecting a material, and the characteristics of the photoreceptor can be designed in various ways, and thus has been widely put into practical use in recent years.

From the viewpoint of resource saving, the development of a long-life photoreceptor is required in order to reduce the frequency of photoreceptor replacement. A factor that determines the life of the photoreceptor is the film loss of the outermost surface layer. As the film loss progresses, image defects such as black spots due to image fog and photoreceptor leakage occur. Accordingly, attempts have been made to increase the film thickness of the outermost surface layer to achieve a longer life.

In addition, it is known that uneven charging that causes scaly image unevenness occurs when the voltage applied to the charging roller exceeds a certain threshold voltage (for example, Journal of the Imaging Society of Japan, Vol. 42, No. 3, p. 209-p. 214). Moreover, it is known that when the surface layer of the photoreceptor is thickened, the capacitance of the photoreceptor is reduced and the aforementioned threshold voltage is increased. (for example, Journal of the Imaging Society of Japan, Vol. 56, No. 1, p. 98-p. 106).

SUMMARY OF THE INVENTION

When the film thickness of the outermost surface layer of the photoreceptor is increased in order to extend the life of the photoreceptor, uneven charging occurs in the actual use area of the image forming apparatus, and scaly image unevenness occurs.

The present invention has been made in view of such circumstances, and provides an image forming apparatus capable of forming a high quality image for a long period of time.

The present invention provides an image forming apparatus including a photoreceptor, a charger that charges a surface of the photoreceptor, an exposer that irradiates the charged surface of the photoreceptor with light to form an electrostatic latent image, a developer that develops the electrostatic latent image to form a toner image, a transferer that transfers the toner image onto a recording medium, a cleaner that removes residual toner on the surface of the photoreceptor, and an inductor. The photoreceptor includes a conductive substrate and a photoreceptive layer provided on the conductive substrate. The conductive substrate is connected to a ground via the inductor.

By electrically connecting the conductive substrate of the photoreceptor included in the image forming apparatus of the present invention to the ground via the inductor, the threshold voltage at which abnormal discharge occurs can be lowered, and the occurrence of scaly charging unevenness (scaly image unevenness) can be easily suppressed in the actual use area. This was clarified by the experiments conducted by the present inventors. In addition, the film thickness of the outermost surface layer of the photoreceptive layer can be increased, and the life of the photoreceptor can be extended. As a result, according to the image forming apparatus of the present invention, a high quality image can be formed for a long period of time.

DESCRIPTION OF THE PREFERRED EMBODIMENTS

Figure 1:
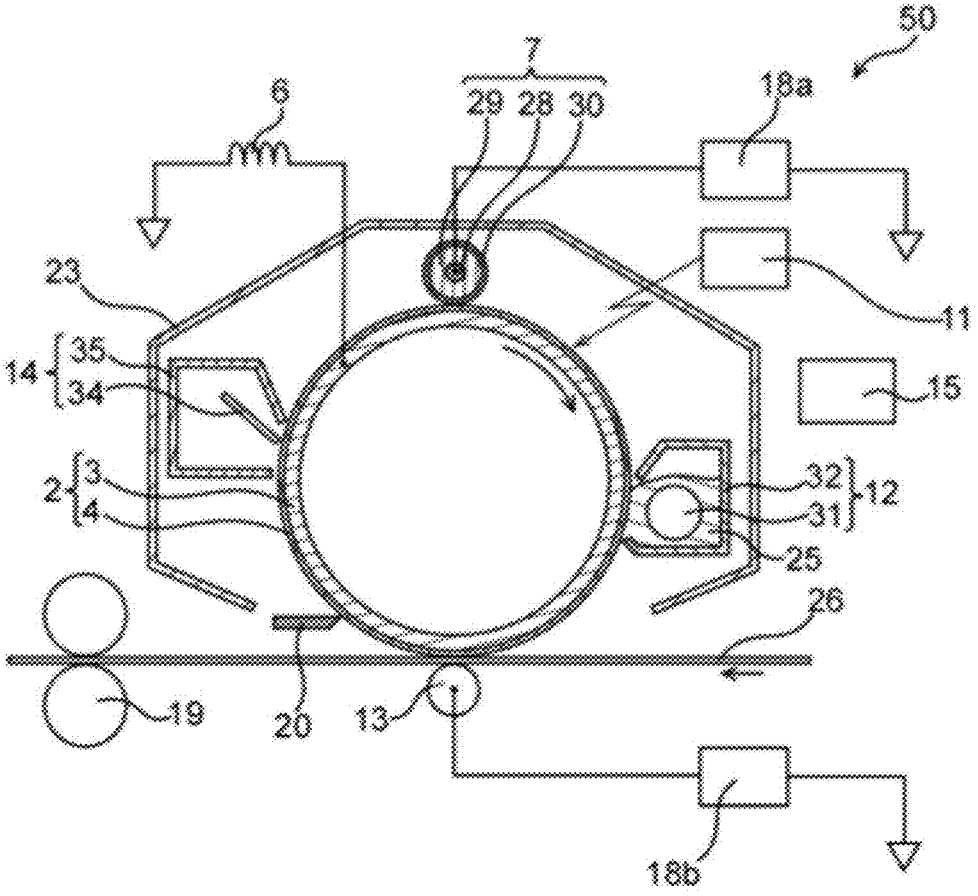
FIG. 1 is a schematic diagram of an image forming apparatus according to an embodiment of the present invention.

The image forming apparatus of the present invention includes a photoreceptor, a charger that charges a surface of the photoreceptor, an exposer that irradiates the charged surface of the photoreceptor with light to form an electrostatic latent image, a developer that develops the electrostatic latent image to form a toner image, a transferer that transfers the toner image onto a recording medium, a cleaner that removes residual toner on the surface of the photoreceptor, and an inductor. The photoreceptor includes a conductive substrate and a photoreceptive layer provided on the conductive substrate. The conductive substrate is connected to a ground via the inductor.

The inductance of the inductor is preferably 10 mH or more and 500 mH or less. This makes it possible to improve the image quality of the image forming apparatus. Specifically, when the inductance is 10 mH to 500 mH, it is possible to suppress the occurrence of scaly charging unevenness on a halftone image, and it is possible to improve white spots and image fog. This has been demonstrated by experiments conducted by the inventors of the present application.

The inductor is preferably a variable inductor.

It is preferable that the controller of the image forming apparatus of the present invention is provided so as to change an inductance of the inductor in accordance with the usage environment of the image forming apparatus, a thickness of the charge transporting layer of the photoreceptor, or a thickness of the monolayer-type photoreceptive layer of the photoreceptor. As a result, it is possible to prevent deterioration of image quality due to changes in the usage environment, changes in the thickness of the photoreceptive layer, and the like. In addition, according to the experiments conducted by the present inventors, it has become clear that the print quality is good when the thickness of the charge transporting layer is relatively thick and the inductance of the inductor is large, and the print quality is good when the film thickness of the charge transporting layer is relatively thin and the inductance of the inductor is small. Therefore, as the charge transporting layer or the monolayer-type photoreceptive layer becomes thinner, the inductance of the inductor can be reduced to suppress the deterioration of print quality.

The thickness of the charge transporting layer of the photoreceptive layer or the thickness of the monolayer-type photoreceptive layer is preferably 34 μm or more and 46 μm or less. As a result, the life characteristics of the photoreceptor can be improved, and a high-quality image can be formed. In addition, in the experiments conducted by the present inventors, the print quality was good in the experiments in which the thickness of the charge transporting layer was 34 μm, 40 μm, and 46 μm. The charger is preferably provided so as to charge the surface of the photoreceptor by bringing the surface of the charger into contact with or close to the surface of the photoreceptor, and the surface roughness Rz of the surface of the charger is preferably 5.0 μm or more and 13 μm or less. This makes it possible to improve the image quality of the image forming apparatus. In addition, in the experiments conducted by the present inventors, the print quality was improved in the experiments in which the surface roughness Rz of a charging roller was 5.0 μm, 8.2 μm, and 13.0 μm.

Hereinafter, the present invention will be described in more detail with reference to a plurality of embodiments. The configurations illustrated in the drawings and the following description are examples, and the scope of the present invention is not limited to those illustrated in the drawings and the following description.

First Embodiment

FIG. 1 is a schematic diagram of an image forming apparatus of the present embodiment.

The image forming apparatus 50 includes a photoreceptor 2, a charger 7 that charges a surface of the photoreceptor 2, an exposer 11 that irradiates the charged surface of the photoreceptor 2 with light to form an electrostatic latent image, a developer 12 that develops the electrostatic latent image to form a toner image, a transferer 13 that transfers the toner image onto a recording medium 26, a cleaner 14 that removes residual toner on the surface of the photoreceptor 2, and an inductor 6. The photoreceptor 2 includes a conductive substrate 3 and a photoreceptive layer 4 provided on the conductive substrate 3. The conductive substrate 3 is connected to the ground via the inductor 6.

In addition, the image forming apparatus 50 can include a fixer 19, power supplies 18*a* and 18*b*, a controller 15, a separation claw 20, a static eliminator, and the like.

(1) Image Forming Apparatus

The image forming apparatus 50 is an electrophotographic image forming apparatus that forms an image with the use of electrophotographic technology. The image forming apparatus 50 may be a monochrome image forming apparatus capable of forming a monochrome image such as that illustrated in FIG. 1, or may be an intermediate transfer type color image forming apparatus capable of forming a color image. The image forming apparatus 50 is, for example, a so-called tandem type full-color image forming apparatus having a configuration in which a plurality of photoreceptors on which toner images are formed are arranged side by side in a predetermined direction (for example, a horizontal direction or a vertical direction). In addition, the image forming apparatus 50 may be another color image forming apparatus, a copier, a multifunction peripheral, or a facsimile.

(2) Photoreceptor

The photoreceptor 2 is a member on which an electrostatic latent image and a toner image are formed on the surface thereof, and an image is continuously formed by rotating the photoreceptor 2. The photoreceptor 2 is, for example, a photoreceptor drum.

The photoreceptor 2 is rotatably supported by the main body (not illustrated) of the image forming apparatus 50, and rotationally driven by a driver (not illustrated). The driver includes an electric motor and a reduction gear, and their driving forces are transmitted to the conductive substrate 3 constituting a core body of the photoreceptor 2, and the photoreceptor 2 is thereby rotationally driven at a predetermined peripheral velocity. The charger 7, exposer 11, developer 12, transferer 13, and cleaner 14 are provided in this order from the upstream side to the downstream side in the rotation direction of the photoreceptor 2 along the outer peripheral surface of the photoreceptor 2. Each component constituting the image forming apparatus 50 is housed in a case (housing) 23.

The photoreceptor 2 includes the conductive substrate 3 and the photoreceptive layer 4 provided on the conductive substrate 3. In addition, the photoreceptor 2 may include an undercoat layer 10 between the conductive substrate 3 and the photoreceptive layer 4. The photoreceptive layer 4 may be a laminated-type photoreceptive layer or a monolayer-type photoreceptive layer.

Figure 2A:
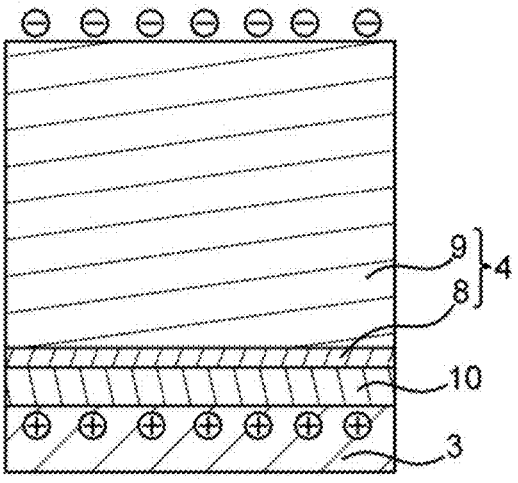
FIG. 2A is a schematic cross-sectional view of a laminated-type photoreceptive layer.
Figure 2B:
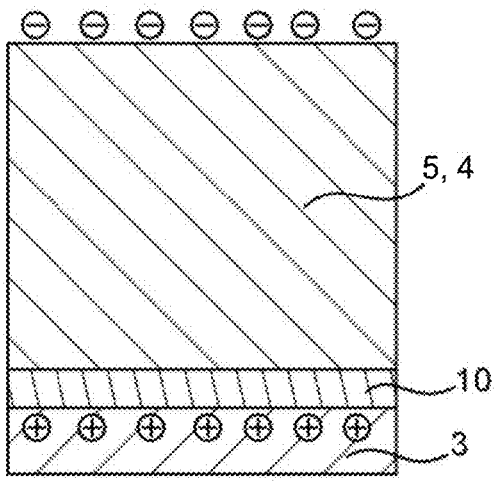
FIG. 2B is a schematic cross-sectional view of a monolayer-type photoreceptive layer.

FIG. 2A is a schematic cross-sectional view illustrating the configuration of the main part of the photoreceptor 2 including a laminated-type photoreceptive layer, and FIG. 2B is a schematic cross-sectional view illustrating the configuration of the main part of the photoreceptor 2 including a monolayer-type photoreceptive layer.

The laminated-type photoreceptive layer (photoreceptive layer 4) has a structure in which a charge generating layer 8 containing a charge generating substance and a charge transporting layer 9 containing a charge transporting substance are laminated in this order on the conductive substrate 3. The monolayer-type photoreceptive layer (photoreceptive layer 4) contains a charge generating substance and a charge transporting substance and is provided on the conductive substrate 3.

(2-1) Conductive Substrate

The conductive substrate 3 has a function as an electrode of the photoreceptor 2 and a function as a support member, and the constituent material of the substrate is not particularly limited as long as the material is used in the art.

The constituent materials of the conductive substrate 3 include, for example, a metal material such as aluminum, aluminum alloy, copper, zinc, stainless steel, and titanium, as well as a polymer material such as polyethylene terephthalate, polyamide (nylon) polyester, polyoxymethylene, and polystyrene, a hard paper, and a glass, in which their surfaces are laminated with a metal foil, vapor-deposited with a metal, or vapor-deposited or coated with a layer of a conductive compound such as a conductive polymer, tin oxide and indium oxide, and the like. Among these materials, aluminum and aluminum alloy is preferable from the viewpoint of ease of processing, and aluminum alloys such as JIS3003 series (Al—Mn series), JIS5000 series (Al—Mg series), and JIS6000 series (Al—Mg—Si series) are particularly preferable.

The shape of the conductive substrate 3 is not limited to the cylindrical shape (drum shape) such as that illustrated in FIG. 1, and may be a sheet shape, a columnar shape, an endless belt shape, or the like.

The diameter and length of the conductive substrate 3 are, for example, approximately 10 to 300 mm and approximately 200 to 1000 mm, respectively.

In addition, as necessary, the surface of the conductive substrate 3 may be subjected to anodic oxidation coating, surface treatment with chemicals or hot water, coloring, or irregular reflection treatment such as surface roughening without affecting an image quality, in order to prevent interference fringes due to laser beam.

The conductive substrate 3 is connected to the ground via the inductor 6. This makes it possible to improve the quality of a printed image. This will be described later.

(2-2) Undercoat Layer

The undercoat layer 10 is arranged between the conductive substrate 3 and the photoreceptive layer 4. The undercoat layer 10 generally covers irregularities of the surface of the conductive substrate 3 to make the surface uniform and to improve the film formability of the photoreceptive layer 4. Thus, the removal of the photoreceptive layer 4 from the conductive substrate 3 can be suppressed, and the adhesiveness between the conductive substrate 3 and the photoreceptive layer 4 can be improved. Specifically, charge injection from the conductive substrate 3 into the photoreceptive layer 4 is prevented, and a decrease in the charging property of the photoreceptive layer 4 is prevented, and thus image fog (so-called black spots) can be prevented.

The undercoat layer 10 can be formed by, for example, a process in which a binder resin is dissolved or dispersed in an appropriate solvent to prepare an undercoat layer-forming coat liquid, this coat liquid is applied on the surface of the conductive substrate 3, and the organic solvent is removed by drying.

Examples of the binder resin include acetal resin, polyamide resin, polyurethane resin, polyester resin, acrylic resin, epoxy resin, phenol resin, melanin resin, urethane resin, casein, gelatin, polyvinyl alcohol, ethyl cellulose, and the like. One type of these can be used alone or two or more types can be used in combination.

Among these binder resins, the binder resin is preferably the polyamide resin, particularly preferably an alcohol-soluble nylon resin and a polyamide resin containing a piperazine-based compound, because the binder resin is demanded to have properties such as insolubility and unswelling property in the solvent used in forming the photoreceptive layer 4 on the undercoat layer 10, excellent adhesiveness with the conductive substrate 3, and flexibility. Examples of the alcohol-soluble nylon resin include a homopolymerized or copolymerized nylon such as 6-nylon, 66-nylon, 610-nylon, 11-nylon and 12-nylon, a chemically-modified nylon such as N-alkoxymethyl-modified nylon, and the like.

In addition, a curing agent that crosslinks the binder resin may be used to form a cured film. The curing agent is preferably a blocked isocyanate from the viewpoint of storage stability and an electric property of the coat liquid.

Examples of the solvent include water, a lower alcohol such as methanol, ethanol, n-propyl alcohol, isopropyl alcohol, n-butanol, 2-butanol, and isobutanol, a ketone such as acetone, cyclohexanone, and 2-butanone, an ether such as tetrahydrofuran, dioxane, ethylene glycol, and diethyl ether, a halogenated hydrocarbon such as methylene chloride and ethylene chloride. With regard to these solvents, appropriate solvents are selected depending on the solubility of the binder resin, the surface smoothness of the undercoat layer 10, and the like, and one type of these can be used alone or two or more types can be used in combination.

Among these solvents, for example, a non-halogen organic solvent can be suitably used in consideration of the global environment.

The undercoat layer-forming coat liquid may contain metal oxide particles. With the metal oxide particles, it is possible to easily adjust a volume resistivity value of the undercoat layer 10, to further suppress charge injection into the charge generating layer 8 and the monolayer-type photoreceptive layer 5, and to maintain the electric property of the photoreceptor 2 under various environments.

Examples of a material that can be used as the metal oxide particle include titanium oxide, aluminum oxide, aluminum hydroxide, tin oxide, and the like.

A ratio (A/B) of a total mass A of the binder resin and the metal oxide particle to a mass B of the solvent in the undercoat layer-forming coat liquid is preferably about 1/99 to 40/60, particularly preferably about 2/98 to 30/70, for example.

In addition, a ratio (C/D) of a mass C of the binder resin to a mass D of the metal oxide particle is preferably about 90/10 to 1/99, particularly preferably about 70/30 to 5/95, for example.

As a method for applying the undercoat layer-forming coat liquid, it is only necessary to appropriately select an optimum method in consideration of physical properties and productivity of the coat liquid, and examples of the method include a spray method, a bar coating method, a roll coating method, a blade method, a ring method, an immersion coating method, and the like.

Among these methods, in the immersion coating method, the conductive substrate 3 is immersed in a coating tank filled with a coat liquid, and then raised at a constant speed or a continuously changing speed to form a layer on the surface of the conductive substrate 3. This immersion coating method is relatively simple and excellent in the productivity and the cost, and therefore can be suitably used for producing the photoreceptor 2. An apparatus used in the immersion coating method may be equipped with a coat liquid disperser typified by an ultrasonic wave generator for the purpose of stabilizing dispersibility of the coat liquid.

The solvent in the coat film may be removed by natural drying, but may be forcibly removed by heating.

A temperature in such a drying process is not particularly limited as long as the solvent used can be removed, but the temperature is suitably about 50 to 140° C., and particularly preferably about 80 to 130° C. If the drying temperature is lower than 50° C., the drying time is prolonged, and the solvent does not sufficiently evaporate and remains in the undercoat layer 10 in some cases. In addition, if the drying temperature is higher than about 140° C., the electric property of the photoreceptor 2 during repeated use becomes poor, and an obtained image is deteriorated in some cases.

Such a temperature condition is common in formation of not only the undercoat layer 10 but also a layer such as a photoreceptive layer 4 described later, and other treatments.

The film thickness of the undercoat layer 10 is not particularly limited, but is preferably 0.01 to 20 μm, more preferably 0.05 to 10 μm. If the film thickness of the undercoat layer 10 is less than 0.01 μm, it is impossible to obtain sufficient effects on the blocking property against electron injection from the conductive substrate side and the countermeasure against interference fringes due to light scattering in some cases. On the other hand, if the film thickness of the undercoat layer 10 is more than 20 μm, the change in sensitivity increases during continuous printing, and therefore the change in image density increases in some cases.

(2-3) Charge Generating Layer

The charge generating layer 8 has a function of generating charges by absorbing light emitted from a light emitter, such as a light beam like a semiconductor laser in an electrophotographic apparatus such as the image forming apparatus 50. The charge generating layer 8 contains a charge generating substance as a main component and, as necessary, contains a binder resin and additives.

The charge generating substance is not particularly limited as long as it is a material used in the art.

Examples of the charge generating substance include: organic photoconductive materials such as an azo-based pigment such as a monoazo-based pigment, a bisazo-based pigment, and a trisazo-based pigment, an indigo-based pigment such as indigo and thioindigo, a perylene-based pigment such as peryleneimide and perylenic acid anhydride, a polycyclic quinone-based pigment such as anthraquinone and pyrenequinone, a phthalocyanine-based compound such as a metallic phthalocyanine like oxotitanium phthalocyanine and a non-metal phthalocyanine, a squarylium pigment, a pyrylium salt, a thiopyrylium salt, and a triphenylmethane pigment; and inorganic photoconductive materials such as selenium and amorphous silicone; and the like. A charge generating substance having sensitivity at an exposure wavelength range can be appropriately selected for use, and one type of these can be used alone or two or more types can be used in combination.

Among these charge generating substances, the phthalocyanine-based compound is preferable, oxotitanyl phthalocyanine is more preferable, and crystalline oxotitanyl phthalocyanine (also referred to as "titanyl phthalocyanine") is particularly preferable.

Crystalline oxotitanyl phthalocyanines include α-type, β-type, Y-type, and other crystalline types. Among these, Y-type oxotitanyl phthalocyanine is preferable in terms of image characteristics. Y-type oxotitanyl phthalocyanine having at least diffraction peaks at Bragg angles (2θ±0.2°) of 7.3°, 9.4°, 9.7°, 26.2°, and 27.3° and having the maximum peak in the overlapping peak bundle of 9.4° and 9.7° in the X-ray diffraction spectrum using CuKα ray (wavelength 1.541 Å) is particularly preferable.

A method for forming the charge generating layer 8 is preferably a method in which the charge generating substance is dispersed in a binder resin solution obtained by mixing a binder resin in a solvent by a conventionally known method, and a charge generating layer-forming coat liquid is applied on the conductive substrate 3 or the undercoat layer 10. This method will be explained below.

The binder resin is not particularly limited, and a bindable resin used in the art and the binder resin exemplified in the description of the undercoat layer 10 can be used. A binder resin excellent in compatibility with the charge generating substance is preferable.

Examples of the binder resin include polyester, polystyrene, polyurethane, a phenol resin, an alkyd resin, a melamine resin, an epoxy resin, a silicone resin, an acrylic resin, a methacrylic resin, polycarbonate, polyarylate, a polyphenoxy resin, polyvinyl butyral (PVB), polyvinyl formal, a copolymer resin containing two or more of repeating units constituting these resins, and the like. Examples of the copolymer resin include insulating resins such as vinyl chloride-vinyl acetate copolymer resin, a vinyl chloride-vinyl acetate-maleic anhydride copolymer resin, and an acrylonitrile-styrene copolymer resin, and the like, and one type of these can be used alone or two or more types can be used in combination.

Examples of the solvent include: a halogenated hydrocarbon such as dichloromethane and dichloroethane; a ketone such as acetone, methyl ethyl ketone, and cyclohexanone; an ester such as ethyl acetate and butyl acetate; an ether such as tetrahydrofuran (THF) and dioxane; an alkyl ether of ethylene glycol, such as 1,2-dimethoxyethane; an aromatic hydrocarbon such as benzene, toluene, and xylene; an aprotic polar solvent such as N,N-dimethylformamide and N,N-dimethylacetamide; and the like. One type of these can be used alone or two or more types can be used in combination. Among these solvents, for example, a non-halogen organic solvent can be suitably used in consideration of the global environment.

Similarly to the undercoat layer 10, a disperser such as a paint shaker, a ball mill, and a sand mill can be used to dissolve or disperse the charge generating substance in the binder resin solution. In doing so, impurities are generated from a container and members constituting the disperser due to wear or the like, and therefore it is preferable to appropriately set dispersion conditions to keep the impurities from getting mixed with the coat liquid.

Preferably, a ratio (E/F) of a mass E of the charge generating substance to a mass F of the binder resin is, for example, about 80/20 to 50/50.

The film thickness of the charge generating layer 8 is not particularly limited, but is preferably 0.05 to 5 μm, more preferably 0.1 to 1 μm.

If the film thickness of the charge generating layer 8 is less than 0.05 μm, a light absorption efficiency decreases and the sensitivity of the photoreceptor 2 decrease in some cases. On the other hand, if the film thickness of the charge generating layer 8 is more than 5 μm, the charge transfer inside the charge generating layer 8 is at a rate-limiting stage in a process of erasing the charges on the photoreceptive layer 4 surface, and the sensitivity of the photoreceptor 2 decreases in some cases.

(2-4) Charge Transporting Layer

The charge transporting layer 9 has a function of receiving the charges generated by the charge generating substance and transporting the charges to the surface of the photoreceptor 2, and contains the charge transporting substance, the binder resin, and, if necessary, additives.

The charge transporting substance is not particularly limited, and compounds used in the art can be used.

Examples of the charge transporting substance include a carbazole derivative, a pyrene derivative, an oxazole derivative, an oxadiazole derivative, a thiazole derivative, a thiadiazol derivative, a triazole derivative, an imidazole derivative, an imidazolone derivative, an imidazolidine derivative, a bisimidazolidine derivative, a styryl compound, a hydrazone compound, a polycyclic aromatic compound, an indole derivative, a pyrazoline derivative, an oxazolone derivative, a benzimidazole derivative, a quinazoline derivative, a benzofuran derivative, an acridine derivative, a phenazine derivative, an aminostilbene derivative, a triarylamine derivative, a triarylmethane derivative, a phenylenediamine derivative, a stilbene derivative, an enamine derivative, a benzidine derivative, a polymer having a group derived from these compounds on a main chain or a side chain (poly-N-vinylcarbazole, poly-1-vinylpyrene, ethylcarbazole-formaldehyde resin, triphenylmethane polymer, poly-9-vinyl anthracene, or the like), a polysilane, and the like. One type of these can be used alone or two or more types can be used in combination.

A method for forming the charge transporting layer 9 is preferably a method in which the charge transporting substance is dispersed in a binder resin solution obtained by mixing a binder resin in a solvent using a conventionally known method, and a charge transporting layer-forming coat liquid is applied on the charge generating layer 8. This method will be explained below.

The binder resin is not particularly limited, a bindable resin used in the art can be used, and a binder resin excellent in compatibility with the charge transporting substance is preferable.

Examples of the binder resin include a vinyl polymer resin such as polymethylmethacrylate, polystyrene, and polyvinyl chloride and copolymer resins thereof, as well as a resin such as polycarbonate, polyester, polyester carbonate, polysulfone, polyphenoxy resin, epoxy resin, silicone resin, polyarylate, polyamide, polyether, polyurethane, polyacrylamide, phenol resin, and polyphenylene oxide, a thermosetting resin obtained by partially crosslinking these resins, and the like. One type of these can be used alone or two or more types can be used in combination.

Among these binder resins, polystyrene, polycarbonate, polyarylate, and polyphenylene oxide are preferable because they have a volume resistivity value of $10^{13}\Omega$ or higher, excellent electric insulation, and excellent film formability and potential property. Among them, polycarbonate is particularly preferable.

Examples of the solvent include: an aromatic hydrocarbon such as benzene, toluene, xylene, and monochlorobenzene; a halogenated hydrocarbon such as dichloromethane and dichloroethane; an ether such as tetrahydrofuran, dioxane, and dimethoxymethyl ether; and an aprotic polar solvent such as N,N-dimethylformamide; and the like. In addition, a solvent such as an alcohol, acetonitrile, and methyl ethyl ketone can be further added and used, as needed, and one type of these can be used alone or two or more types can be used in combination.

Among these solvents, for example, a non-halogen organic solvent can be suitably used in consideration of the global environment.

Preferably, a ratio (G/H) of a mass G of the charge transporting substance to a mass H of the binder resin is, for example, about 10/12 to 10/30.

The film thickness of the charge transporting layer 9 is not particularly limited, but is preferably 5 to 50 μm, more preferably 36 to 46 μm in the present invention. This makes it possible to extend the life of the photoreceptor 2. By increasing the film thickness of the charge transporting layer 9, scaly charging unevenness (scaly image unevenness) may occur. However, in the image forming apparatus 50 of the present embodiment, the conductive substrate 3 is connected to the ground via the inductor 6, and it is thereby possible to suppress the occurrence of uneven charging (image unevenness).

If the film thickness of the charge transporting layer 9 is less than 5 μm, charge retainability of the photoreceptor surface decreases in some cases. On the other hand, if the film thickness of the charge transporting layer 9 is more than 50 μm, resolution of the photoreceptor 2 decreases in some cases.

(2-5) Monolayer-Type Photoreceptive Layer

The monolayer-type photoreceptive layer 5 can be formed in the same manner as when the undercoat layer 10 is formed. For example, a charge generating substance, a charge transporting substance, and a binder resin are dissolved or dispersed in an appropriate solvent to prepare a photoreceptive layer-forming coat liquid, and the photoreceptive layer-forming coat liquid is applied onto the undercoat layer 10 by the immersion coating method or the like to form the monolayer-type photoreceptive layer 5.

As the binder resin, the binder resin exemplified in the description of the charge generating layer 8 is preferable.

The monolayer-type photoreceptive layer 5 may contain an appropriate amount of the same additives as those contained in the charge generating layer 8.

The content of the charge generating substance in the monolayer-type photoreceptive layer 5 is preferably about 0.2 to 20% by mass with respect to the total solid content of the monolayer-type photoreceptive layer 5.

The film thickness of the monolayer-type photoreceptive layer 5 is not particularly limited, but is preferably 5 to 100 μm, more preferably 10 to 50 μm. If the film thickness of the monolayer-type photoreceptive layer 5 is less than 5 μm, the charge retainability of the photoreceptor surface decreases in some cases. On the other hand, if the film thickness of the monolayer-type photoreceptive layer 5 exceeds 100 μm, the productivity in the production of the photoreceptor 2 may decrease.

(3) Charger

The charger 7 is a device that uniformly charges the surface of the photoreceptor 2 to a predetermined potential. As the charger 7, for example, a contact charger having a roller shape, a belt shape, a blade shape, or the like can be used.

It is optimal that the voltage is applied to the charger 7 only by the direct current voltage from the viewpoint of the cost of the power supply (high voltage applying device) 18*a*, the life of the photoreceptor 2 and the charger 7, and the like.

Here, an example in which a roller-shaped contact charger is used as the charger 7 will be described.

The charger 7 can have an elastic layer 29 and a resistance layer 30 as a coating layer in this order on the outer peripheral surface of a conductive support 28 as a substrate.

(3-1) Conductive Support

The conductive support 28 is not particularly limited as long as it is conductive and can retain the strength of the charger 7, and for example, a round bar made of at least one metal material selected from iron, copper, stainless steel, aluminum, and nickel. In addition, the surface of the conductive support 28 may be plated in order to prevent rust and impart scratch resistance, as long as the conductivity is not impaired.

(3-2) Elastic Layer

The elastic layer 29 has appropriate conductivity and elasticity in order to supply power to the photoreceptor 2 as a charged body and to ensure good uniform adhesion of the charger 7 to the photoreceptor 2.

In order to ensure uniform adhesion between the charger 7 and the photoreceptor 2, the elastic layer 29 is preferably in a shape (so-called crown shape) in which the elastic layer 29 is polished and the central portion thereof is the thickest and the elastic layer 29 becomes thinner from the central portion toward both end portions.

Generally, the charger 7 comes into contact with the photoreceptor 2 by applying a predetermined pressing force to both end portions of the conductive support 28. Therefore, the pressing force is small at the central portion and large at the both end portions. Consequently, there is no issue when the straightness of the charger 7 is sufficient, but there is an issue that density unevenness occurs in the images corresponding to the central portion and both end portions when the straightness is not sufficient. In addition, since the charging region is expanding due to the increase in A3+ compatible models and the number of color machines, there is an issue that the charger 7 per se is easily bent by the pressing force applied only to the both end portions of the conductive support 28, and there is a gap in the central portion. For this reason, it is preferable that the elastic layer 29 has a crown shape.

The elastic layer 29 can be formed by a known method by appropriately adding, to an elastic material such as rubber, a conductive agent having an electron conduction mechanism such as carbon black, graphite, and conductive metal oxides, and a conductive agent having an ion conduction mechanism such as alkali metal salts and quaternary ammonium salts. The volume resistance is preferably adjusted so as to exhibit conductivity of less than 1×1010 Ωcm.

Examples of the elastic material include natural rubber, synthetic rubber such as ethylene propylene rubber (EPDM), styrene butadiene rubber (SBR), silicone rubber, urethane rubber, epichlorohydrin rubber, isoprene rubber (IR), butadiene rubber (BR), nitrile butadiene rubber (NBR), and chloroprene rubber (CR), and further include polyamide resin, polyurethane resin, and silicone resin.

The film thickness of the elastic layer 29 is not particularly limited, but, for example, is preferably 1 to 3 mm, more preferably 1.5 to 2 mm.

(3-3) Resistance Layer

The resistance layer 30 is formed in contact with the elastic layer 29 to prevent bleeding out of softening oil, plasticizer, and the like contained in the elastic layer 29 to the surface of the charger, and is provided to adjust the electrical resistance of the entire charger.

Examples of the material forming the resistance layer 30 include epichlorohydrin rubber, nitrile butadiene rubber (NBR), polyolefin-based thermoplastic elastomer, urethane-based thermoplastic elastomer, polystyrene-based thermoplastic elastomer, fluororubber-based thermoplastic elastomer, polyester-based thermoplastic elastomer, polyamide-based thermoplastic elastomer, polybutadiene-based thermoplastic elastomer, ethylene vinyl acetate-based thermoplastic elastomer, polyvinyl chloride-based thermoplastic elastomer, and chlorinated polyethylene-based thermoplastic elastomer. One of these can be used alone or two or more can be used as a mixture or copolymer.

The resistance layer 30 has conductive or semi-conductive properties. Therefore, the resistance layer 30 is formed by appropriately adding, to the above material, a conductive agent having an electron conduction mechanism (for example, conductive carbon, graphite, conductive metal oxide, copper, aluminum, nickel, iron powder, etc.) or a conductive agent having an ion conduction mechanism (for example, alkali metal salt, ammonium salt, etc.).

In this case, two or more kinds of various conductive agents may be used in combination in order to obtain a desired electrical resistance. However, considering environmental changes and contamination of the photoreceptor, it is preferable to use a conductive agent having an electron conduction mechanism.

The charger 7 preferably has a surface roughness Rz of 5.0 μm or more and 13 μm or less. Indexes indicating the surface roughness include, for example, ten-point average surface roughness (Rz), arithmetic average roughness (Ra), maximum roughness (Ry), average spacing of irregularities (Sm), and the like. In the present invention, "surface roughness" means ten-point average surface roughness (Rz) unless otherwise specified.

The surface of the charger 7 is usually formed with irregularities, but by setting the surface roughness of the charger 7 within the above range, it is possible to always secure a stable charging potential and to secure a level of toner cleaning performance that does not cause any problems. Thus, a good image can always be obtained. In particular, when only a direct current voltage is applied to the charger 7, a protrusion (projection) on the surface of the charger becomes an appropriate discharge point, and a stable charging potential can always be secured. That is, by forming a protrusion and a recess on the surface of the charger 7, the protrusion charges the surface of the photoreceptor 2.

If the surface roughness of the charger 7 is less than 3.0 μm, it may not be possible to suppress scaly charging unevenness on a halftone image. On the other hand, if the surface roughness of the charger 7 exceeds 16 μm, the scaly charging unevenness on a halftone image can be suppressed, but image fog may worsen.

The surface roughness of the charger 7 can be adjusted by changing the polishing conditions of the surface layer (resistance layer 30) of the charger 7. In addition, in order to further stabilize the charging, the surface layer (resistance layer 30) of the charger 7 may contain a filler. In this case, it is desirable to improve the dispersed state of the protrusions on the surface of the charger by changing the type and particle size of the filler.

The filler is not particularly limited as long as the effect of the invention is not significantly impaired. Examples of the filler include calcium carbonate, talc, mica, silica, alumina, aluminum hydroxide, magnesium hydroxide, barium sulfate, zinc oxide, zeolite, wollastonite, silica soil, glass beads, bentonite, montmorillonite, asbestos, hollow glass bulb, black lead, molybdenum disulfide, titanium oxide, aluminum fiber, stainless steel fiber, brass fiber, aluminum powder, wood flour, rice husk, graphite, metal powder, conductive metal oxide, organic metal compound, organic metal salt, and the like. One type of these can be used alone or two or more types can be used in combination.

The film thickness of the resistance layer 30 is not particularly limited, but, for example, is preferably 5 to 100 μm, more preferably 5 to 20 μm.

(4) Exposer

The exposer 11 is a device that emits modulated light on the basis of image information. The exposer 11 can include a semiconductor laser or a light emitting diode as a light source, and can expose the surface of the charged photoreceptor 2 to lights according to image information by irradiating the surface (outer peripheral surface) of the photoreceptor 2 between the charger 7 and the developer 12 with a laser beam light output from the light source. The lights are repeatedly scanned in an extending direction of the rotation axis of the photoreceptor 2 as a main scanning direction, and these lights form an image, and thus electrostatic latent images are sequentially formed on the surface of the photoreceptor 2. That is, the presence or absence of laser beam irradiation causes differences in the charge amount of the photoreceptor 2 uniformly charged by the charger 7, to form the electrostatic latent images.

(5) Developer

The developer 12 is a device for developing the electrostatic latent image formed on the surface of the photoreceptor 2 by exposure with the use of developing powder (including toner 25) and provided facing the photoreceptor 2, and includes a developing roller 31 for feeing the toner to the surface of the photoreceptor 2, and a casing 32 for supporting the developing roller 31 rotatably around a rotation axis parallel to or substantially parallel to the rotation axis of the photoreceptor 2 and housing the developing powder containing the toner 25 in its own internal space.

(6) Transferer

The transferer (transfer charger) 13 is a device for transferring a toner image as a visible image formed on the surface of the photoreceptor 2 by development onto a transfer paper that is a recording medium 26 fed to between the photoreceptor 2 and the transferer 13 from a predetermined conveyance direction by a conveyor not illustrated. The transferer 13 applies a predetermined high voltage to a transfer nip portion formed between the photoreceptor 2 and the transferer 13 by a power supply **18*b* (high voltage applying device). The transferer 13 can be configured in the same manner as the charger 7, and is, for example, a contact-type transferer that transfers a toner image onto the recording medium 26 by applying a charge antipolar to the toner 25 onto the recording medium 26**.

(7) Fixer

The fixer (fixing device) 19 is a device for fixing the toner image transferred to the recording medium 26 by the transferer 13 to the recording medium 26. The fixer 19 is provided on the downstream side of the transfer nip portion between the photoreceptor 2 and the transferer 13 in the conveyance direction of the recording medium 26. For example, the fixer 19 includes a heating roller and a pressure roller provided so as to face the heating roller, and the pressure roller is pressed by the heating roller to form a fixing nip portion.

(8) Cleaner

The cleaner 14 is a cleaning device that removes and collects the toner remaining on the surface of the photoreceptor 2 after the transfer operation by the transferer 13. The cleaner 14 includes a cleaning blade 34 for peeling off the toner 25 remaining on the surface of the photoreceptor 2, and a collection casing 35 for housing the toner 25 peeled off by the cleaning blade 34.

(9) Static Eliminator, Separation Claw

The image forming apparatus 50 preferably further includes a static eliminator that eliminates the surface charge remaining on the photoreceptor 2, and can be provided together with the cleaner 14. In addition, it is preferable that the image forming apparatus 50 further includes a separation claw 20 that separates the recording medium 26 from the photoreceptor 2.

(10) Operation of Image Forming Apparatus

The operation of the image forming apparatus 50 will be described. First, when the photoreceptor 2 is rotationally driven in a predetermined direction by the driver, a negative charge is supplied to the surface of the photoreceptor 2 from the charger 7 provided on the upstream side in the rotation direction of the photoreceptor 2 with respect to the imaging point of the light by the exposer 11, and the surface of the photoreceptor 2 is uniformly charged to a predetermined potential. For example, as illustrated in FIGS. 2A and 2B, a negative charge is accumulated on the surface of the photoreceptor 2, and the surface of the photoreceptor 2 is charged. In addition, as illustrated in FIGS. 2A and 2B, a positive charge is generated on the surface of the conductive substrate 3 facing the surface of the charged photoreceptor 2 due to the Coulomb force of the negative charge on the surface of the photoreceptor 2. As a result, the negative charge on the surface of the photoreceptor 2 is stabilized, and the surface of the photoreceptor 2 is uniformly charged. Therefore, in order to suppress the occurrence of uneven charging, it is important to quickly generate a positive charge on the surface of the conductive substrate 3 by the Coulomb force of the negative charge on the surface of the photoreceptor 2.

In addition, the surface of the negatively charged photoreceptor 2, the surface of the positively charged conductive substrate 3, and the photoreceptive layer 4 between the two can be regarded as a capacitor having the photoreceptive layer 4 as a dielectric layer.

Moreover, since the conductive substrate 3 is connected to the ground via the inductor 6, when a positive charge is generated on the surface of the conductive substrate 3 by the Coulomb force, the electric charge flows between the conductive substrate 3 and the ground, and thus the charge balance of the conductive substrate 3 is adjusted. Furthermore, the inductor 6 can suppress a sudden change in the flow of electric charge. As a result, a positive charge can be quickly generated on the surface of the conductive substrate 3. The circuit diagram of the charger 7 and the photoreceptor 2 can be represented as illustrated in FIG. 3, for example.

Figure 3:
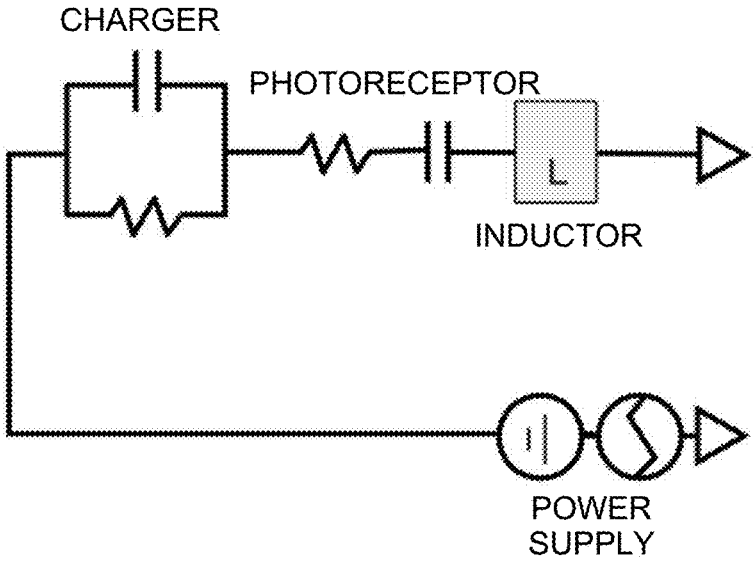
FIG. 3 is a circuit diagram of a charger and a photoreceptor included in the image forming apparatus according to the embodiment of the present invention.
Figure 4:
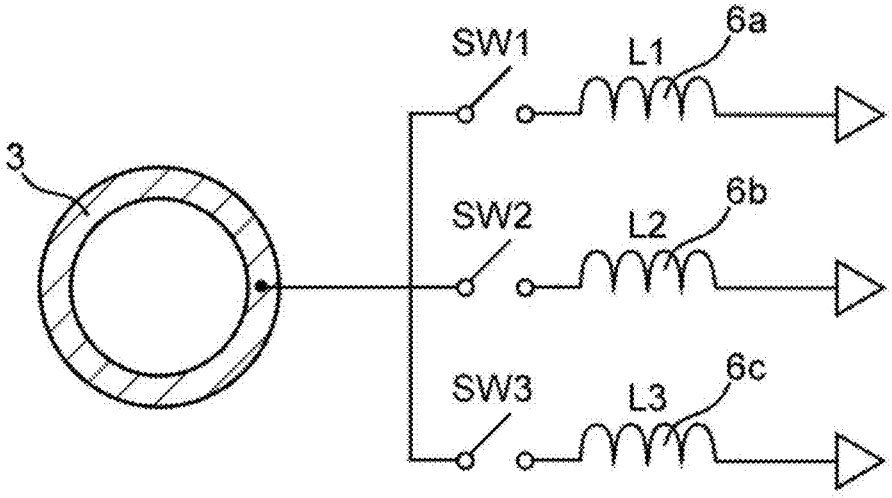
FIG. 4 is a circuit diagram for explaining switching of inductors.

Although one inductor 6 is illustrated in FIG. 3, the image forming apparatus 50 may have a plurality of inductors 6 having different inductances between the conductive substrate 3 and the ground. In addition, the plurality of inductors 6 can be provided in such a manner that the inductor 6 between the conductive substrate 3 and the ground can be switched. For example, as illustrated in FIG. 4, the image forming apparatus 50 can have inductors 6*a* to 6*c* (having different inductances L1 to L3). In addition, the inductor 6 between the conductive substrate 3 and the ground can be switched with the use of switches SW1 to SW3.

Next, the exposer 11 irradiates the surface of the uniformly charged photoreceptor 2 with light according to image information. In the photoreceptor 2, the surface charges of the part irradiated with light are removed by this exposure, and a difference is caused between the surface potential of the part irradiated with light and the surface potential of the part not irradiated with light, and thus an electrostatic latent image is formed.

From the developer 12 provided on the downstream side in the rotation direction of the photoreceptor 2 with respect to the imaging point of the light by the exposer 11, the toner 25 is fed to the surface of the photoreceptor 2 on which the electrostatic latent image is formed. The electrostatic latent image is developed, and a toner image is formed.

The recording medium 26 is supplied to the transfer nip portion between the photoreceptor 2 and the transferer 13 from the conveyance direction of the recording medium 26 in synchronization with the exposure to the photoreceptor 2. An electric charge antipolar to the toner is applied to the supplied recording medium 26 by the transferer 13, and thus the toner image formed on the surface of the photoreceptor 2 is transferred onto the recording medium 26.

The recording medium 26 to which the toner image is transferred is conveyed to the fixer 19 by the conveyor, and heated and pressurized when passing through the contact portion between the heating roller and the pressure roller of the fixer 19 and fixing nip portion, and the toner image is fixed to the recording medium 26 to obtain a robust image. The recording medium 26 on which the image is formed in this way is ejected to the outside of the image forming apparatus 50 by the conveyor.

On the other hand, the toner 25 remaining on the surface of the photoreceptor 2 even after the toner image is transferred by the transferer 13 is peeled off from the surface of the photoreceptor 2 by the cleaning blade 34 of the cleaner 14 and collected in the collection casing 35.

In this way, the electric charge on the surface of the photoreceptor 2 from which the toner 25 has been removed is removed, and the electrostatic latent image on the surface disappears. After that, the photoreceptor 2 is further rotationally driven, and a series of operations starting from charging are repeated again to continuously form the images.

In a case where the image forming apparatus 50 includes a static eliminator on the downstream side of the cleaner 14 and before reaching the charger 7, the light from the static eliminator lamp of the static eliminator efficiently and more reliably removes the electric charge on the surface of the photoreceptor 2, and the electrostatic latent image on the surface of the photoreceptor 2 disappears.

(11) Controller

The controller 15 is a part that controls the image forming apparatus 50. The controller 15 can include, for example, a microprocessor having a CPU, a memory, a timer, an input/output port, and the like. The memory of the controller 15 stores control software for controlling the image forming apparatus 50.

In addition, the image forming apparatus 50 can include a temperature/humidity sensor provided so as to detect the usage environment of the image forming apparatus 50.

(12) Inductor

The inductor 6 (coil) is an element in which a conducting wire is wound in a coil shape. The inductor 6 has an inductance L corresponding to a cross-sectional area S of the coil, a number of winding N, and a core (magnetic permeability μ).

The inductor 6 may or may not have a core. The inductor 6 can be formed, for example, by using a ferromagnetic or ferrimagnetic material as a core and winding an electric wire such as a copper wire around the core. By using a core material with a higher magnetic permeability than that of air, the magnetic field can be strengthened and confined in the coil, thereby increasing the inductance L.

The core is not particularly limited, and materials used in the art, for example, ferrite, molybdenum, nickel, iron, carbonyl iron, iron, and silicon aluminum can be used.

The inductor 6 is not particularly limited, but a choke coil that is used in a power supply circuit or a high-power signal circuit and that interferes with a high-frequency alternating current and passes a relatively low-frequency alternating current or a direct current is more preferable.

The inductance of the inductor 6 is preferably 10 mH or more and 500 mH or less.

At 3 mH or less, the impedance change is small, and the effect of suppressing scaly charging unevenness may not be exhibited. In addition, at 600 mH or more, harmful white spots may occur.

The inductor 6 is provided in such a manner that the conductive substrate 3 is connected to the ground via the inductor 6. As a result, it is possible to suppress the occurrence of scaly image unevenness. This was clarified by the experiments conducted by the present inventors.

The reason why the occurrence of image unevenness can be suppressed by providing the inductor 6 is not clear, but it is considered as follows.

In general, impedance matching between the charger 7 and the photoreceptor 2 has a great influence on the scaly charging unevenness.

Figure 5:
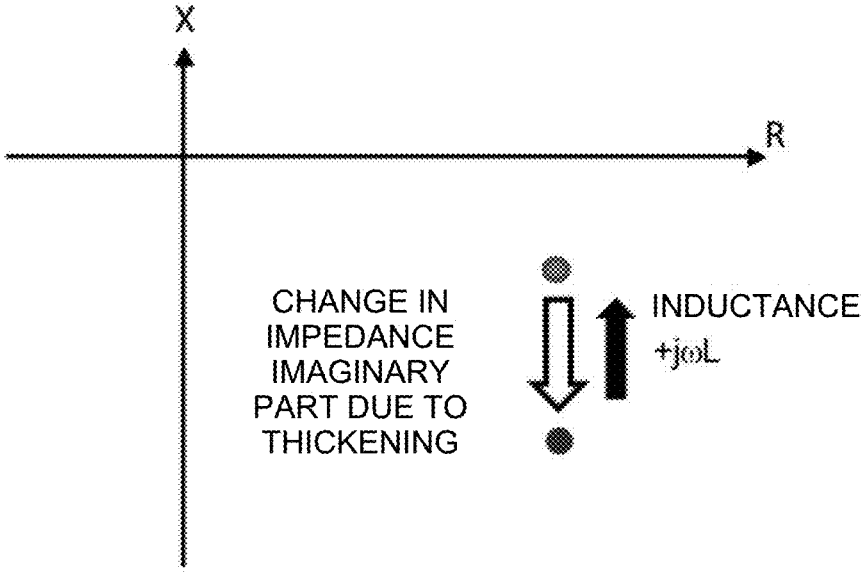
FIG. 5 is an explanatory diagram of an impedance change.

Suppose that an impedance Zroll of the charger 7 is constant, an impedance Zopc of the photoreceptor 2=R+j($\omega L-1/\omega C$), and it is considered that the impedance is restored by complementing, by the inductor 6, the change in impedance due to the decrease in a capacitance C (capacitance of the above-mentioned capacitor) by the thickening of the photoreceptive layer 4 (FIG. 5), and stable charging is possible.

Second Embodiment

Figure 6:
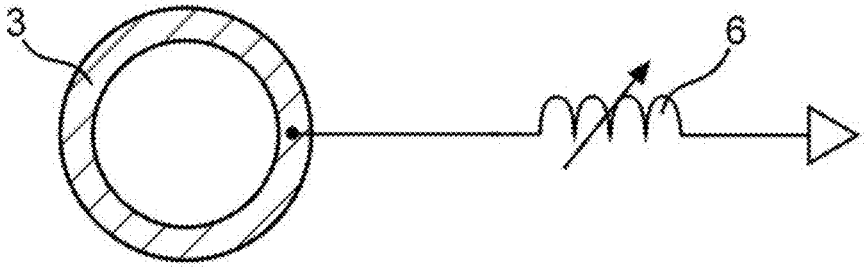
FIG. 6 is a circuit diagram for explaining a connection of a variable inductor.

In the second embodiment, the inductor 6 is a variable inductor. The variable inductor is an inductor provided in such a manner that the inductance can be changed. The variable inductor has a structure capable of moving the core in the coil. In the variable inductor, the inductance can be changed by changing the magnetic permeability by moving the core and shifting the position from the winding. The movement of the core can be controlled by the controller 15. Therefore, the inductance of the variable inductor can be controlled with the use of the controller 15. For example, the variable inductor can be provided as in the circuit diagram such as that illustrated in FIG. 6.

The scaly unevenness, white spots, fog, and the like of a printed image (halftone image, white solid image, etc.) of the image forming apparatus 50 appear slightly depending on the usage environment of the image forming apparatus 50, the thickness of the charge transporting layer 9, or the thickness of the monolayer-type photoreceptive layer 5. The occurrence of such slight scaly unevenness, white spots, fog, and the like can be suppressed by changing the inductance of the variable inductor. Therefore, it is possible to prevent deterioration of image quality due to changes in the usage environment, changes in the thickness of the photoreceptive layer 4, and the like.

Specifically, the controller 15 can be provided so as to move the core of the variable inductor on the basis of the measurement result of the temperature/humidity sensor to change the inductance. As a result, the inductance can be changed in accordance with the usage environment.

In addition, the controller 15 can be provided so as to move the core of the variable inductor on the basis of the integrated rotation speed of the photoreceptor to change the inductance. Since the thickness of the charge transporting layer 9 or the thickness of the monolayer-type photoreceptive layer 5 can be predicted from the integrated rotation speed, the inductance can be changed in accordance with the thickness of the charge transporting layer 9 or the thickness of the monolayer-type photoreceptive layer 5.

Other configurations are the same as those in the first embodiment. In addition, the description of the first embodiment also applies to the second embodiment as long as there is no contradiction.

Fabrication Experiment of Image Forming Apparatus

A photoreceptor having a film thickness d of the charge transporting layer illustrated in Table 1, a charging roller having a surface roughness Rz illustrated in Table 1, and an inductor having an inductance L illustrated in Table 1 were fabricated. The photoreceptor, charging roller, and inductor were incorporated into a modified test copier (trade name: MX-B455 W, manufactured by Sharp Corporation) to produce the image forming apparatus of examples 1 to 21. In addition, the image forming apparatus of comparative examples 1 and 2 in which the inductor is not provided between the conductive substrate and the ground and the image forming apparatus of comparative examples 3 and 4 in which the capacitor is provided between the conductive substrate and the ground were also fabricated. A laminated ceramic capacitor (manufactured by Murata Manufacturing Co., Ltd.) was used as the capacitor.

The photoreceptor was fabricated as follows.

3 parts by mass of titanium oxide (trade name: TS-043, manufactured by Showa Denko K.K.) and 2 parts by mass of copolymerized polyamide (nylon) (trade name: CM8000, manufactured by Toray Industries, Inc.) were added to 25 parts by mass of methyl alcohol, which was dispersed in a paint shaker (disperser) for 8 hours to prepare 3 kg of the undercoat layer-forming coat liquid.

Subsequently, an immersion coating method is performed, specifically, the obtained coat liquid is charged in the coating bath, and a drum-shaped aluminum substrate having a diameter of 30 mm and a length of 225 mm is immersed in the coat liquid, then raised, and dried to form an undercoat layer having a film thickness of 1.0 μm.

1 parts by mass of the Y-type oxotitanyl phthalocyanine (trade name: TPL-530, manufactured by Nippon Materials Co., Ltd.) as the charge generating substance, and 1 parts by mass of a polyvinyl butyral (PVB) resin (trade name: BX-1, manufactured by Sekisui Chemical Company, Limited) as the binder resin were added to 98 parts by mass of methyl ethyl ketone, and the mixture was dispersed using glass beads (trade name: BZ-1, manufactured by AS ONE CORPORATION, bead diameter: 1 mm) as the medium in a paint shaker for 2 hours to prepare 3 kg of the charge generating layer-forming coat liquid.

Subsequently, similarly to the formation of the undercoat layer, the charge generating layer-forming coat liquid was applied on the surface of the undercoat layer by the immersion coating method. Specifically, the obtained charge generating layer-forming coat liquid is charged in a coating bath, and a drum-shaped substrate on which the undercoat layer is formed is immersed in the coat liquid, then raised, and naturally dried to form a charge generating layer having a film thickness of 0.2 μm.

[Formula 1]

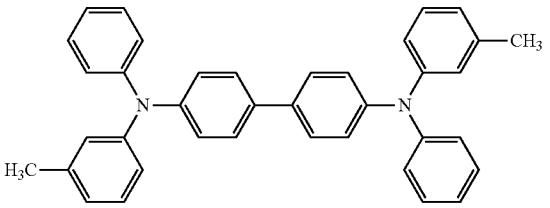

24 parts by mass of tetrahydrofuran were added to 2 parts by mass of a triphenylamine compound (TPD) (trade name: D2448, manufactured by Tokyo Chemical Industry Co., Ltd.) represented by [Formula 1] as the charge transporting substance and 3 parts by mass of Z-type polycarbonate (trade name: TS2050 manufactured by Teijin Chemicals Ltd.) as the binder resin, which was stirred and mixed to prepare 3 kg of the charge transporting layer-forming coat liquid.

Subsequently, similarly to the formation of the undercoat layer, the charge transporting layer-forming coat liquid was applied on the surface of the charge generating layer by the immersion coating method. Specifically, the obtained charge transporting layer-forming coat liquid is charged in a coating bath, and a drum-shaped substrate on which the charge generating layer is formed is immersed in the coat liquid, and then the raising speed was changed to thereby obtain the film thicknesses of examples 1 to 21 and comparative examples 1 to 4 illustrated in Table 1. After that, the substrate was dried at 130° C. for 1 hour to form charge transporting layers having various film thicknesses.

Specifically, the film thickness d of the charge transporting layer was set to 48 μm in examples 18 and 19, the film thickness d of the charge transporting layer was set to 46 μm in examples 16 and 17, the film thickness d of the charge transport layer was set to 40 μm in examples 1 to 10 and comparative examples 2 to 4, the film thickness d of the charge transporting layer was set to 34 μm in examples 14 and 15 and comparative example 1, the film thickness d of the charge transporting layer was set to 32 μm in examples 11 to 13, and the film thickness d of the charge transporting layer was set to 28 μm in examples 20 and 21.

A photoreceptor was fabricated as described above.

The charging roller was fabricated as follows. 100 parts by mass of ethylene-propylene-diene ternary copolymer (ethylene propylene rubber, EPDM) as the elastic material, 10 parts by mass of carbon black as the conductive agent, and 10 parts by mass of urethane foam as a foaming agent were kneaded to obtain an elastic layer-forming rubber.

The obtained rubber is poured into a mold in which a conductive support made of SUM23 (free cutting steel product) having a diameter of 9 mm and a length of 355 mm is set in advance, and heated at an internal temperature of 160° C. for 30 minutes with the use of an electric furnace. Then, vulcanization and foaming were performed to form an elastic layer having a film thickness of 2 mm.

100 parts by mass of a polyamide-based thermoplastic elastomer as an elastic material and 20 parts by mass of carbon black as a conductive agent were kneaded to obtain a resistance layer-forming rubber.

The obtained rubber was melt-extruded with the use of an annular die to fabricate a seamless tube as a resistance layer. Air was blown from one end of the obtained seamless tube, and the resistance layer was formed by inserting a conductive support (roller) having an elastic layer formed in the tube while inflating the tube.

The surface of the obtained charging roller was processed to obtain the surface roughness RZ of examples 1 to 21 and comparative examples 1 to 4 illustrated in Table 1. The surface roughness RZ was measured as a ten-point average surface roughness (Rz) with the use of a surface roughness measuring instrument (model: SE-30H, manufactured by Kosaka Laboratory Co., Ltd.).

Specifically, the surface roughness Rz was set to 8.2 μm in examples 1 to 6, 11 to 21, and comparative examples 1 to 4, the surface roughness Rz was set to 4.0 μm in example 7, the surface roughness Rz was set to 5.0 μm in examples 8, the surface roughness Rz was set to 13.0 μm in example 9, and the surface roughness Rz was set to 15.2 μm in example 10.

As described above, a charging roller having a diameter of 14 mm was fabricated.

The inductor was fabricated as follows.

Ferrite was used as the core, and a copper wire was wound around the core to change the number of winding thereof to fabricate the inductors of examples 1 to 21 illustrated in Table 1.

Specifically, the inductance L of the inductor was set to 3 mH in example 1, the inductance L of the inductor was set to 10 mH in examples 2, 11 and 20, the inductance L of the inductor was set to 100 mH in examples 3, 12 and 14, the inductance L of the inductor was set to 200 mH. In examples 4, 7 to 10, 13, 15, 16 and 21, the inductance L of the inductor was set to 500 mH in examples 5, 17 and 18, and the inductance L of the inductor was set to 600 mH in examples 6 and 19.

In the image forming apparatus of examples 1 to 21, the conductive substrate of the photoreceptor was connected to the ground via the fabricated inductor. In the image forming apparatuses of comparative examples 1 and 2, the conductive substrate of the photoreceptor was connected to the ground via a conducting wire (neither an inductor nor a capacitor was provided). In the image forming apparatuses of comparative examples 3 and 4, the conductive substrate of the photoreceptor was connected to the ground via a capacitor (manufactured by Murata Manufacturing Co., Ltd.).

TABLE 1

| | PHOTORECEPTOR - GROUND | | FILM THICKNESS d OF CHARGE TRANSPORTING LAYER | SURFACE ROUGHNESS Rz OF CHARGING ROLLER |
|---|---|---|---|---|
| EXAMPLE 1 | INDUCTANCE L | 3 mH | 40 μm | 8.2 μm |
| EXAMPLE 2 | INDUCTANCE L | 10 mH | 40 μm | 8.2 μm |
| EXAMPLE 3 | INDUCTANCE L | 100 mH | 40 μm | 8.2 μm |
| EXAMPLE 4 | INDUCTANCE L | 200 mH | 40 μm | 8.2 μm |
| EXAMPLE 5 | INDUCTANCE L | 500 mH | 40 μm | 8.2 μm |
| EXAMPLE 6 | INDUCTANCE L | 600 mH | 40 μm | 8.2 μm |
| EXAMPLE 7 | INDUCTANCE L | 200 mH | 40 μm | 4.0 μm |
| EXAMPLE 8 | INDUCTANCE L | 200 mH | 40 μm | 5.0 μm |
| EXAMPLE 9 | INDUCTANCE L | 200 mH | 40 μm | 13.0 μm |
| EXAMPLE 10 | INDUCTANCE L | 200 mH | 40 μm | 15.2 μm |
| EXAMPLE 11 | INDUCTANCE L | 10 mH | 32 μm | 8.2 μm |
| EXAMPLE 12 | INDUCTANCE L | 100 mH | 32 μm | 8.2 μm |
| EXAMPLE 13 | INDUCTANCE L | 200 mH | 32 μm | 8.2 μm |
| EXAMPLE 14 | INDUCTANCE L | 100 mH | 34 μm | 8.2 μm |
| EXAMPLE 15 | INDUCTANCE L | 200 mH | 34 μm | 8.2 μm |
| EXAMPLE 16 | INDUCTANCE L | 200 mH | 46 μm | 8.2 μm |
| EXAMPLE 17 | INDUCTANCE L | 500 mH | 46 μm | 8.2 μm |
| EXAMPLE 18 | INDUCTANCE L | 500 mH | 48 μm | 8.2 μm |
| EXAMPLE 19 | INDUCTANCE L | 600 mH | 48 μm | 8.2 μm |

TABLE 1-continued

| | PHOTORECEPTOR - GROUND | | FILM THICKNESS d OF CHARGE TRANSPORTING LAYER | SURFACE ROUGHNESS Rz OF CHARGING ROLLER |
|---|---|---|---|---|
| EXAMPLE 20 | INDUCTANCE L | 10 mH | 28 μm | 8.2 μm |
| EXAMPLE 21 | INDUCTANCE L | 200 mH | 28 μm | 8.2 μm |
| COMPARATIVE EXAMPLE 1 | NONE | 0 | 34 μm | 8.2 μm |
| COMPARATIVE EXAMPLE 2 | NONE | 0 | 40 μm | 8.2 μm |
| COMPARATIVE EXAMPLE 3 | CAPACITANCE C | 100 pF | 40 μm | 8.2 μm |
| COMPARATIVE EXAMPLE 4 | CAPACITANCE C | 5 μF | 40 μm | 8.2 μm |

Printed Image Evaluation Experiment

The printed image of the image forming apparatus of examples 1 to 21 and comparative examples 1 to 4 was evaluated in each environment of ° C./85% (high temperature/high humidity), 25° C./50% (normal temperature/normal humidity), and 5° C./10% (low temperature/low humidity). Specifically, scaly charging unevenness, white spots, and fog were evaluated.

[Evaluation 1: Scaly Charging Unevenness]

Under each environment, the photoreceptor surface potential V0/development bias DVB was set to ⁻750 V/⁻600 V, ⁻600 V/⁻450 V, ⁻450 V/⁻300 V, and ⁻300 V/⁻150 V, respectively, and evaluated with a halftone image.

On the basis of the obtained results, the image output with the worst photoreceptor surface potential V0/development bias DVB was determined in accordance with the following criteria.

VG: No unevenness is seen and the image is very good.

G: Good with almost no unevenness.

NB: Some unevenness is seen, but the image can be used in practice.

B: Unevenness is clearly seen and the image is not good.

[Evaluation 2: White Spots]

Under each environment, the photoreceptor surface potential V0/development bias DVB was set to ⁻750 V/⁻600 V, ⁻600 V/⁻450 V, ⁻450 V/⁻300 V, and ⁻300 V/⁻150 V, respectively, and evaluated with a halftone image.

On the basis of the obtained results, the image output with the worst photoreceptor surface potential V0/development bias DVB was determined in accordance with the following criteria.

VG: No white spots are seen and the image is very good.

G: Good with almost no white spots.

NB: Some white spots are seen, but the image can be used in practice.

B: White spots are clearly seen and the image is not good.

[Evaluation 3: Fog]

Under each environment, the photoreceptor surface potential V0/development bias DVB was set to ⁻750 V/⁻600 V, and a solid white image was measured with the use of a spectroscopic color difference meter (colorimetric color difference meter, manufactured by Nippon Denshoku Industries Co., Ltd., model: SZ90 type), and the image fog was evaluated. The obtained results were determined in accordance with the following criteria.

VG: Very good (ΔB. G.<0.40).

G: Good (0.40≤ΔB. G.<0.70).

G: Not bad (0.70≤ΔB. G.<1.00).

B: Not good (1.00≤ΔB. G.).

[Comprehensive Evaluation]

On the basis of the determination results of evaluations 1 to 3, comprehensive determination was conducted in accordance with the following criteria.

VG: In each item, there are 5 or more evaluation VGs, and there are no evaluations NB and B.

G: There are no evaluations NB and B in each item.

NB: There is one or more NBs.

B: There is one or more B.

The results obtained are illustrated in Table 2.

TABLE 2

| | HIGH TEMPERATURE/ HIGH HUMIDITY 30° C./85% | | | NORMAL TEMPERATURE/ NORMAL HUMIDITY 25° C./50% | | | LOW TEMPERATURE/ LOW HUMIDITY 5° C./10% | | | |
|---|---|---|---|---|---|---|---|---|---|---|
| | HALFTONE IMAGE | | WHITE | HALFTONE IMAGE | | WHITE | HALFTONE IMAGE | | WHITE | COMPRE- |
| | SCALY UNEVEN-NESS | WHITE SPOTS | SOLID IMAGE FOG | SCALY UNEVEN-NESS | WHITE SPOTS | SOLID IMAGE FOG | SCALY UNEVEN-NESS | WHITE SPOTS | SOLID IMAGE FOG | HENSIVE DETER-MINATION |
| EXAMPLE 1 | G | VG | G | G | VG | G | VG | G | VG | G |
| EXAMPLE 2 | G | VG | G | VG | VG | G | VG | G | VG | VG |
| EXAMPLE 3 | VG | VG | G | VG | VG | G | VG | VG | VG | VG |
| EXAMPLE 4 | VG | VG | G | VG | VG | G | VG | VG | VG | VG |
| EXAMPLE 5 | VG | G | G | VG | VG | G | VG | VG | VG | VG |
| EXAMPLE 6 | VG | G | G | VG | G | G | VG | G | VG | G |
| EXAMPLE 7 | G | G | VG | G | G | VG | VG | G | VG | G |
| EXAMPLE 8 | G | VG | VG | VG | VG | VG | VG | VG | VG | VG |
| EXAMPLE 9 | VG | VG | G | VG | VG | VG | VG | VG | VG | VG |
| EXAMPLE 10 | VG | G | G | VG | G | G | VG | VG | G | G |
| EXAMPLE 11 | VG | G | G | VG | G | G | VG | G | VG | G |
| EXAMPLE 12 | VG | G | G | VG | G | G | VG | G | VG | G |
| EXAMPLE 13 | VG | G | G | VG | G | G | VG | G | VG | G |
| EXAMPLE 14 | VG | VG | G | VG | VG | G | VG | VG | VG | VG |
| EXAMPLE 15 | VG | G | G | VG | G | G | VG | G | VG | G |

TABLE 2-continued

| | HIGH TEMPERATURE/ HIGH HUMIDITY 30° C./85% | | | NORMAL TEMPERATURE/ NORMAL HUMIDITY 25° C./50% | | | LOW TEMPERATURE/ LOW HUMIDITY 5° C./10% | | | |
|---|---|---|---|---|---|---|---|---|---|---|
| | HALFTONE IMAGE | | WHITE | HALFTONE IMAGE | | WHITE | HALFTONE IMAGE | | WHITE | COMPRE- |
| | SCALY UNEVEN-NESS | WHITE SPOTS | SOLID IMAGE FOG | SCALY UNEVEN-NESS | WHITE SPOTS | SOLID IMAGE FOG | SCALY UNEVEN-NESS | WHITE SPOTS | SOLID IMAGE FOG | HENSIVE DETER-MINATION |
| EXAMPLE 16 | G | VG | G | G | VG | G | G | VG | VG | G |
| EXAMPLE 17 | VG | VG | G | VG | VG | G | VG | VG | VG | VG |
| EXAMPLE 18 | G | G | G | G | VG | G | G | VG | VG | G |
| EXAMPLE 19 | G | G | G | G | VG | G | VG | VG | VG | G |
| EXAMPLE 20 | VG | G | G | VG | G | G | VG | G | VG | G |
| EXAMPLE 21 | VG | G | G | VG | G | G | VG | G | VG | G |
| COMPARATIVE EXAMPLE 1 | NB | VG | G | NB | G | VG | G | VG | VG | NB |
| COMPARATIVE EXAMPLE 2 | B | VG | G | B | G | VG | NB | VG | VG | B |
| COMPARATIVE EXAMPLE 3 | B | VG | G | B | G | VG | NB | VG | VG | B |
| COMPARATIVE EXAMPLE 4 | B | VG | G | B | G | VG | NB | VG | VG | B |

The following can be seen from the results in Table 2.

As in examples 1 to 21, by connecting the conductive substrate of the photoreceptor to the ground via the inductor, the occurrence of scaly charging unevenness on a halftone image is suppressed, and the evaluation of white spots and the evaluation of image fog were good.

On the other hand, in comparative examples 1 and 2 in which the photoreceptor and the ground are connected by a conducting wire, and in comparative examples 3 and 4 in which a capacitor is provided between the photoreceptor and the ground, the scaly charging unevenness on a halftone image could not be suppressed.

In examples 1 to 21, the inductance was 10 mH to 500 mH, the occurrence of scaly charging unevenness on a halftone image was further suppressed, and the evaluations of the white spots and image fog were good. Regarding the usage environment, the occurrence of scaly charging unevenness on a halftone image was suppressed with the use of an inductor with higher inductance at high temperature/high humidity. On the other hand, at low temperature/low humidity, if an inductor with high inductance is used, white spots appear on the halftone image, and thus it is preferable to lower the inductance. Therefore, it is possible to provide a higher quality image by changing the inductance in accordance with the environment.

Regarding the film thickness d of the charge transporting layer of the photoreceptor, the thicker the film thickness, the use of an inductor with higher inductance suppressed the occurrence of scaly charging unevenness on a halftone image. On the other hand, the thinner the film thickness, the use of an inductor with higher inductance causes white spots on the halftone image, and thus it is preferable to lower the inductance. Therefore, since the film thickness of the charge transporting layer becomes thinner as the rotation speed of the photoreceptor increases, a higher quality image can be provided by lowering the inductance as the film thickness of the photoreceptor becomes thinner.

For example, in a case where the thickness (initial film thickness) of the charge transporting layer is 46 μm when the total rotation speed of the photoreceptor is 0 k (for example, examples 16 and 17), when the total rotation speed of the photoreceptor is 750 k, the thickness of the charge transporting layer is 40 μm (for example, examples 1 to 6), and when the total rotation speed of the photoreceptor reaches 1500 k, the thickness of the charge transporting layer is 34 μm (for example, examples 14 and 15), and when the total rotation speed of the photoreceptor is 1750 k, the thickness of the charge transporting layer is 32 μm (for example, examples 11 to 13), and when the total rotation speed of the photoreceptor is 2250 k, the thickness of the charge transporting layer is 28 μm (for example, examples 20 and 21).

In examples 16 and 17 corresponding to the total rotation speed of 0 k, the comprehensive determination was Very Good in example 17 with an inductance of 500 mH, whereas the comprehensive determination was Good in example 16 with an inductance of 200 mH.

In examples 2 to 5 (inductance 10 mH to 500 mH) corresponding to the total rotation speed of 750 k, the comprehensive determination was Very Good. In particular, example 4 (inductance 200 mH) was excellent because the number of Very Goods was 7.

In examples 14 and 15 corresponding to the total rotation speed of 1500 k, the comprehensive determination was Very Good in example 14 with an inductance of 100 mH, whereas the comprehensive determination was Good in example 15 with an inductance of 200 mH.

Therefore, in the range of total rotation speeds of 0 k to 1500 k (from the film thickness of the charge transporting layer being 46 μm (initial film thickness) to 34 μm), it was found that the printed image can be kept in good condition by gradually lowering the inductance as the film thickness of the charge transporting layer becomes thinner.

In addition, in the example in which the film thickness of the charge transporting layer was 32 μm or less (total rotation speed was 1750 k or more), there was no significant difference in print quality at an inductance of 10 mH to 200 mH.

Moreover, the effect of providing the inductor is the greatest in the range where the initial film thickness of the charge transporting layer is 34 μm to 46 μm.

For example, a good image can be provided throughout the life of the image forming apparatus by controlling the inductance of the inductor to change stepwise or gradually so as to reach: 500 mH initially (at the total rotation speed of the photoreceptor of 0 k); 200 mH when the total rotation speed of the photoreceptor is 750 K; and 100 mH when the total rotation speed of the photoreceptor is 1500 K. The above is merely an example.

When the surface roughness Rz of the charging roller was in the range of 5.0 to 13.0 μm, the occurrence of scaly charging unevenness on a halftone image was suppressed, and the evaluations of the white spots and image fog were good.

The present invention is not limited to the embodiments described above, and can be implemented in various other forms. The foregoing embodiments are therefore to be considered in all respects illustrative rather than limiting the invention described herein. The scope of the present invention is indicated by the claims, and is not limited to the foregoing description. Furthermore, all modifications and variations belonging to the equivalent scope of the claims are within the scope of the present invention.

What is claimed is:

1. An image forming apparatus comprising: a photoreceptor; a charger that charges a surface of the photoreceptor; an exposer that irradiates the charged surface of the photoreceptor with light to form an electrostatic latent image; a developer that develops the electrostatic latent image to form a toner image; a transferer that transfers the toner image onto a recording medium; a cleaner that removes residual toner on the surface of the photoreceptor; an inductor; and a controller, wherein the photoreceptor includes a conductive substrate and a photoreceptive layer provided on the conductive substrate, wherein the conductive substrate is connected to a ground via the inductor, wherein the inductor is a variable inductor, wherein the photoreceptive layer is a monolayer-type photoreceptive layer or a laminated-type photoreceptive layer, wherein the laminated-type photoreceptive layer includes a charge generating layer provided on the conductive substrate and a charge transporting layer provided on the charge generating layer, and wherein the controller is provided so as to lower an inductance of the inductor in accordance with a total number of rotations of the photoreceptor.

2. The image forming apparatus according to claim 1, wherein an inductance of the inductor is 100 mH or more and 500 mH or less.

3. The image forming apparatus according to claim 1, wherein a thickness of the charge transporting layer or a thickness of the monolayer-type photoreceptive layer is 34 μm or more and 46 μm or less.

4. The image forming apparatus according to claim 1, wherein the charger is provided so as to charge the surface of the photoreceptor by bringing a surface of the charger into contact with or close to the surface of the photoreceptor, and wherein a surface roughness of the surface of the charger is 5.0 μm or more and 13 μm or less.

5. The image forming apparatus according to claim 1, further comprising a temperature/humidity sensor provided so as to detect a usage environment of the image forming apparatus, wherein the controller is provided so as to change an inductance of the inductor in accordance with a measurement result of the temperature/humidity sensor.

6. The image forming apparatus according to claim 1, wherein the variable inductor has a structure capable of moving a core in a coil, and wherein the controller is provided so as to change an inductance of the inductor by moving the core and shifting a position from a winding of the coil.

* * * * *